United States Patent [19]

Hackney

[11] Patent Number: 5,048,442

[45] Date of Patent: Sep. 17, 1991

[54] SPINNAKER HANDLING DEVICES

[76] Inventor: John Hackney, 12420 Kelso Dr., Thonotosassa, Fla. 33592

[21] Appl. No.: 468,074

[22] Filed: Jan. 22, 1990

[51] Int. Cl.[5] ..... B63H 9/04

[52] U.S. Cl. ..... 114/102

[58] Field of Search ..... 114/97, 98, 102-105, 114/39.1

[56] References Cited

U.S. PATENT DOCUMENTS

| | | | |
|---|---|---|---|
| 3,185,121 | 5/1965 | Nilsen | 114/103 |
| 3,207,114 | 9/1965 | Moseley | 114/102 |
| 3,228,372 | 1/1966 | Ridder et al. | 114/102 |
| 4,598,658 | 7/1986 | Eglais | 114/102 |

*Primary Examiner*—Jesus D. Sotelo

*Attorney, Agent, or Firm*—Carroll F. Palmer

[57] ABSTRACT

A spinnaker pole for controlling a spinnaker on a catamaran or other sailcraft has a cap on its fore end and a guy is reeved through a bore that extends axially through the cap and the fore end of said spinnaker pole to exit the pole through an opening in its central portion for belaying in a cam cleat fixed to the pole aft of such opening. A first line extends from the front surface of the cap for attachment to the front of the catamaran's port hull and a second line also extends from the front surface of the cap for attachment to the front of the starboard hull. The aft end of the spinnaker pole is attached to the catamaran's dolphin striker. The first and second lines serve to stabilize the pole's fore end and also prevent the spinnaker sheets from becoming entangled with the pole's fore end when the spinnaker is jibed.

12 Claims, 1 Drawing Sheet

SPINNAKER HANDLING DEVICES

BACKGROUND OF THE INVENTION

1. Field of the Invention

This application relates to improvements in sail handling devices for use with sailboats. More particularly, it concerns new devices for handling spinnaker sails on sailcraft, specifically multihull sailboats and especially high-performance catamarans.

2. Description of the Prior Art

Sailboats may be classified in a variety of ways, i.e., according to (a) rigging, (b) hull configuration, (c) auxiliary power, (d) material of construction, etc.

In terms of rigging, basic classes include single sail boats (cat boats), two sail boats (sloops), three sail boats (ketch, yawl, schooner), etc. The present invention primarily concerns sailboats of the sloop class.

In terms of hull configuration, basic classes are monohull and multihull, e.g., catamarans and trimarans. While this invention may be applied generally to all hull configuration sailcraft, it is particularly concerned with multihull sailboats and especially those of the high performance type, i.e., those that reach high speeds relative to the wind velocity as compared to sailboats of lesser performance ratings.

Sailboats of the sloop class require two basic sails, i.e., a main and a jib. However, many of boats of this class also use a balloon-type sail, called a spinnaker, when sailing across the wind (reaching) or sailing downwind (running) in order to increase sail area and thereby utilize more of the available wind energy to drive the sailcraft faster through the water. However, because of their "balloon" structure designed to expose a great amount of sail area to the wind, the prior art has considered it necessary to use various contraptions that make sailing a boat with a spinnaker more complicated than with the basic main and jib.

By way of example, a problem of use of a spinnaker on a sloop always occurs when it is necessary to jibe the boat, i.e., change the course of the boat wherein the sails pass from one side of the boat to the other with the wind blowing on the sails from behind. Even with a sloop not flying a spinnaker jibing is a serious maneuver because the boom must be brought across the boat without damage to the rigging, but with a spinnaker flying, the endeavor becomes more complicated since there are numerous lines and other equipment that require special attention to prevent them from becoming tangled or fouling other equipment.

The present invention has addressed the spinnaker handling problem related to sailcraft and has overcome line tangling and related problems inherent in spinnaker handling devices available heretofore.

OBJECTS

A principal object of the invention is the provision of improvements in sail handling devices for use with sailboats.

Further objects include the provision of:

1. Novel devices for handling spinnaker sails on sailcraft, specifically multihull sailboats and especially high-performance catamarans.

2. Improved spinnaker poles for use on catamarans that eliminate sheet tangling problems prevalent with spinnaker poles previously available for use on such sailcraft.

3. Improved rigging systems for spinnaker poles on catamarans.

Other objects and further scope of applicability of the present invention will become apparent from the detailed descriptions given herein; it should be understood, however, that the detailed descriptions, while indicating preferred embodiments of the invention, are given by way of illustration only, since various changes and modifications within the spirit and scope of the invention will become apparent from such descriptions.

SUMMARY OF THE INVENTION

The objects are accomplished in accordance with the invention by the provision of improvements for sailcraft comprising a mast and means for flying a spinnaker forward of the mast, particularly catamarans.

Such improvements comprise a novel spinnaker pole for controlling a guy attached to the spinnaker. Such pole includes a fore end, an aft end and an central portion axially connecting the fore end to the aft end. There is a cap on the fore end having front and rear surfaces and a bore extends axially through the cap from the front surface to the rear surface. The spinnaker guy is reeved through the bore and the fore end of the spinnaker pole to exit the pole through an opening in the wall of the pole's central portion and lead aft to the sailcraft.

A first line extends from the front surface of the cap for attachment to a first portion of the sailcraft, and a second line also extends from the front surface of the cap for attachment to a second portion of the sailcraft spaced apart from the first portion.

The pole also includes means for attaching its aft end to the sailcraft and there is a cam cleat fixed thereto aft of the pole wall opening by which the spinnaker guy may be belayed.

In preferred embodiments, (a) the means for attaching to pole comprises a pair of longitudinal slots in its aft end and a removable transverse pin, (b) the pole is formed of a pair of tubular sections spliced together and (c) the cap is cylindrical in shape, the bore for the spinnaker guy is concentric therein and the cap contains an additional pair of axial bores through which the first and second lines are reeved.

In a first embodiment, the first and second lines are fiber rope. In a second embodiment, the first and second lines are wire cables fixed by fasteners to the front surface of the cap.

BRIEF DESCRIPTION OF THE DRAWINGS

A more complete understanding of the invention can be obtained by reference to the accompanying drawings in which.

DESCRIPTION OF THE PREFERRED EMBODIMENTS

Figure 1:
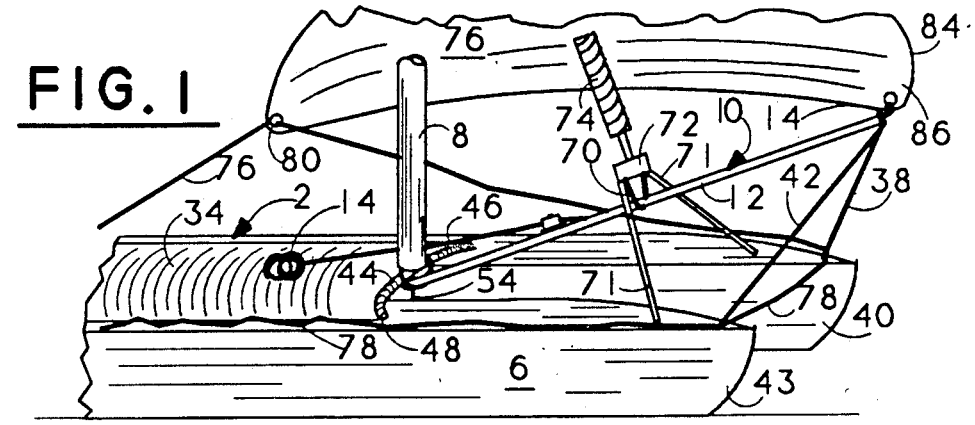
FIG. 1 is an isometric view of a catamaran sailboat equipped with the improved spinnaker handling devices of the invention.

Referring in detail to the drawings, the catamaran 2 comprises port hull 4 and starboard hull 6, mast 8 and means 10 for flying a spinnaker forward of the mast including a spinnaker pole 12 for controlling a guy 14 attached to the spinnaker 16.

The spinnaker pole 12 comprises a fore end 18, an aft end 20 and a central portion 22 axially connecting the fore end 18 to the aft end 20 and a cap 24 on the fore end 18.

The cap 24 includes front surface 26, rear surface 28 and a bore 30 that extends axially through the cap 24 from the front surface 26 to the rear surface 28.

Figure 2:
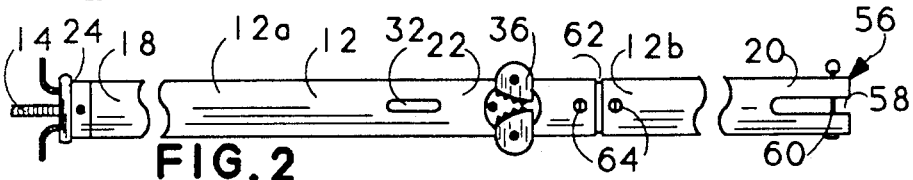
FIG. 2 is a fragmented plan view of an improved spinnaker pole of the invention.
Figure 3:
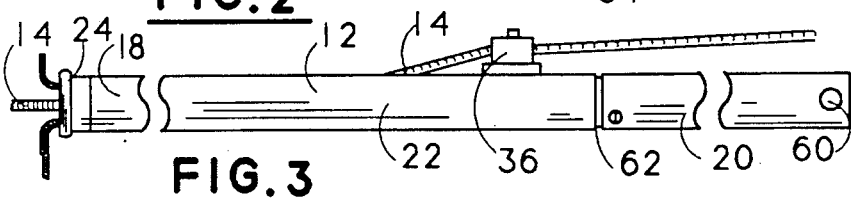
FIG. 3 is a fragmented lateral view of the pole shown in FIG. 2.

The guy 14 is reeved through the bore 30 and the fore end 18 of the pole 12 to exit through an opening 32 in the wall of the central portion 22 and lead aft to the trampoline 34 of the catamaran 2 after passing through the cam cleat 36 fastened on the pole 12 aft of the opening 32. The guy 14 is not shown extending out of the opening 32 in FIG. 2 for the sake of clarity.

A first line 38 extends from the front surface 26 of the cap 24 for attachment somewhere near or behind the front portion 40 of the hull 4 and a second line 42 extends from the front surface 26 of the cap 24 for similar attachment somewhere on the front portion 43 of the hull 6.

The mast 8 is supported on the main beam 44 which is fixed at end 46 to hull 4 and at end 48 to hull 6. A threaded rod 50 extends through the beam 44 and the lower end 52 of mast 8 has a hole in it (not shown) into which the top end of rod 50 fits to hold the mast 8 in position. The lower end 54 of rod 50, which extends below beam 44 to serve as a truss member, is called the "dolphin striker".

Figure 6:
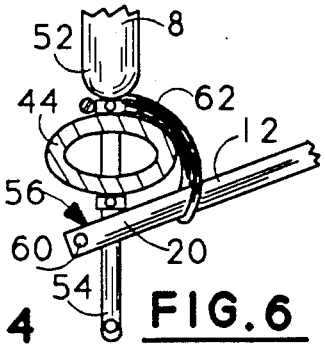
FIG. 6 is a fragmentary view, partially in section, of the aft end of a spinnaker pole of the invention showing its attachment to the catamaran as seen in FIG. 1.

Means 56 for attaching the aft end 20 of the spinnaker pole 12 to the sailcraft 2 comprises a pair of longitudinal slots 58 in aft end 20 and a removable transverse pin 60. As seen in FIG. 6, the slots 58 fit over the dolphin striker 54 and the pin 60 prevents end 20 from slipping off it. A section of elastic cord 62 serves to hold the pole end 20 up against the beam 44.

The spinnaker pole is tubular and advantageously made of extruded metal, e.g., aluminum, in circular cross-section, although construction from other materials, e.g., fiberglass, plastic, etc. and in other sections are possible, e.g., square, hexagonal, etc. Also, the pole can be a single piece from end 18 to end 20, but for shipping and handling purposes, it is preferably made of spliced sections **12*a* and 12*b* that abut at junction 62 about an internal brace (not shown) to which the sections are fastened by screws 64**.

Figure 5:
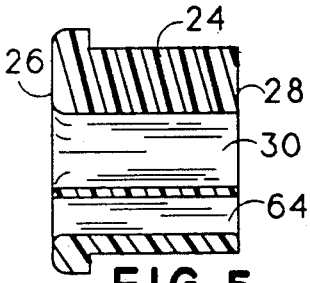
FIG. 5 is a sectional view taken on the line V—V of FIG. 4.
Figure 4:
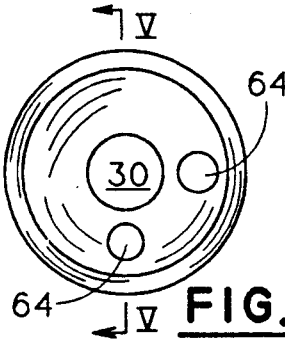
FIG. 4 is a top end view of a first embodiment of a cap for the fore end of a spinnaker pole of the invention.
Figure 7:
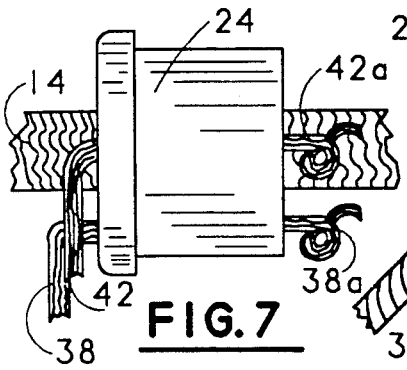
FIG. 7 is a lateral view of the cap of FIG. 4 with a spinnaker guy and positioning lines reeved therein.

Preferably, the cap 24 is cylindrical in shape and the bore 30 is concentric therein (see FIG. 4). Also, in the first embodiment shown in FIGS. 4, 5 and 7, the cap 24 contains a pair of axial bores 64 through which the first and second lines 38 and 42 are reeved and stopped at their bitter ends by knots **38*a* and 42*a*, respectively. In this embodiment, the lines 38 and 42** are fiber rope.

Figure 8:
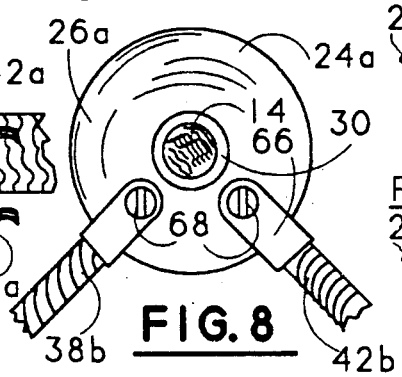
FIG. 8 is a second embodiment of a fore end cap for spinnaker poles of the invention.

In a second embodiment **24*a* of the cap (see FIG. 8), the first and second lines are wire cables 38*b* and 42*b* having swaged end caps 66 fixed by fasteners 68 to the front surface 26*a* of the cap 24*a***.

The lines 38 and 42 serve to position the fore end 18 of the spinnaker pole 12 and the elastic cord 70 which is looped over the bridle wires 71 fixed to the furling drum 72 of the jib 74 tensions the pole end 18 against the restraint of the lines 38 and 42.

Figure 9:
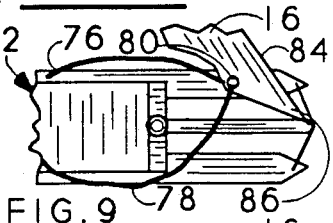
FIG. 9 is a diagrammatic view of a first arrangement of the sheets attached to a spinnaker in the use of a spinnaker pole of the invention.
Figure 10:
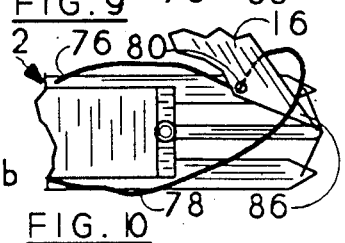
FIG. 10 is a diagrammatic view of a second arrangement of the sheets attached to a spinnaker in the use of a spinnaker pole of the invention.

FIGS. 9 and 10 assist in describing the novel methods of spinnaker sail handling in accordance with this invention that eliminate the problem of sheet entanglement when jibing the spinnaker.

As shown in FIG. 9, the port and starboard spinnaker sheets 76 and 78 respectively are attached to the clew 80 of the spinnaker 16 and lead aft of the luff 84 of the spinnaker 16. Alternatively, as shown in FIG. 10, the sheets 76 and 78 may be arranged to pass in front of the luff 84 when the spinnaker is jibed across the catamaran 2. When this maneuver is performed, the line 38 and 42 prevent the sheets 76 and 78 from becoming entangled with the underside of the pole 12 at the fore end 18 as frequently occurs when a jibe is performed with spinnaker poles of the prior art, In either arrangement of the sheets 76 and 78, the guy 14 is attached to the tack 86 of the spinnaker 16.

When the spinnaker is raised on the mast 8 by a halyard (not shown), the guy 14 is fully pulled into the pole 12 so the tack 86 abuts or is very close to the fore end 18 of the pole 12 and the bulk of the guy 14 lays coiled on the trampoline 34 as shown in FIG. 1. When the time comes to douse the spinnaker 16 and resume sailing with the jib 74, the spinnaker is lowered by payout of its halyard. At the same time, the sheets 76 and 78 along with the spinnaker are pulled aft onto the trampoline 34. However, to enable this to occur, the guy 14 must be eased. This is done by releasing the guy 14 from the cam cleat 36 by an upward pull on the guy 14 aft of the cleat 36. This release permits the coiled portion of the guy 14 to run through the pole 12 and out through the cap 24 so that the spinnaker tack 86 along with all the rest of the spinnaker 16 can be retrieved onto the trampoline 34. This leaves the forward half of the guy 14 extending from the fore end 18 of the pole 12 back to the trampoline 34 and with the other half running from the fore end 18 back through the pole 12, out the opening 32 onto the trampoline 34.

When the time comes to again switch from sailing with the jib to sailing with the spinnaker, the jib is furled by use of the furling drum 72 in known manner and the spinnaker is raised by its halyard. Simultaneously, the tack 86 is drawn into position at the fore end 18 of the pole 12 by pulling the guy 14 through the cap 24 and out the pole opening 32 via the cleat 36 for coiling on the trampoline 34 as previously described.

The embodiments of the invention in which an exclusive property of privilege is claimed are defined as follows:

1. In a multihull sailboat comprising a mast, a spinnaker carried forward of said mast and a spinnaker pole for controlling a guy attached to said spinnaker, the improvement which comprises:

said spinnaker pole comprising a fore end, an aft end and a central portion axially connecting said fore end to said aft end, a cap on said fore end having front and rear surfaces and a bore extending axially through said cap from said front surface to said rear surface, said guy being reeved through said bore and the fore end of said spinnaker pole to exit said pole through an opening in said central portion and lead aft to said sailboat.

a first line extending from said front surface of said cap for attachment to a first portion of said sailboat, a second line extending from said front surface of said cap for attachment to a second portion of said sailboat spaced apart from said first portion, and means for attaching said aft end of said spinnaker pole to said sailboat.

2. A spinnaker pole for controlling a spinnaker guy comprising a fore end, an aft end and a central portion axially connecting said fore end to said aft end, a cap on said fore end having front and rear surfaces and a bore extending axially through said cap from said front surface to said rear surface, said guy being reeved through said bore and the fore end of said spinnaker pole to exit said pole through an opening in said central portion, a first line extending from said front surface of said cap for attachment to a first portion of a sailcraft, a second line extending from said front surface of said cap for attachment to a second portion of said sailcraft spaced apart from said first portion, and means for attaching said aft end of said spinnaker pole to said sailcraft.

3. The spinnaker pole of claim 2 having a cam cleat fixed thereto aft of said opening.

4. The spinnaker pole of claim 2 wherein said means for attaching comprises a pair of longitudinal slots in said aft end and a transverse pin removably fitted in said aft end.

5. The spinnaker pole of claim 2 which is formed of a pair of tubular sections spliced together.

6. The spinnaker pole of claim 2 wherein said cap is cylindrical in shape, said bore is concentric therein and said cap contains an additional pair of axial bores through which said first and second lines are reeved.

7. The spinnaker pole of claim 6 wherein said lines are fiber rope.

8. The spinnaker pole of claim 2 wherein said first and second lines are wire cables fixed by fasteners to said front surface of said cap.

9. In a catamaran comprising a pair of spaced apart port and starboard hulls, a mast supported on a main beam above a dolphin striker, a spinnaker carried forward of said mast and a spinnaker pole for controlling a guy attached to said spinnaker, the improvement which comprises:

said spinnaker pole comprising a fore end, an aft end and an central portion axially connecting said fore end to said aft end, a cap on said fore end having front and rear surfaces and a bore extending axially through said cap from said front surface to said rear surface, said guy being reeved through said bore and the fore end of said spinnaker pole to exit said pole through an opening in said central portion and lead aft to said catamaran via a cam cleat fixed to said pole aft of said opening, a first line extending from said front surface of said cap for attachment to said port hull, a second line extending from said front surface of said cap for attachment to said starboard hull, and said aft end of said spinnaker pole having a pair of longitudinal slots therein into which said dolphin striker extends and is retained by a transverse pin carried in said aft end of said pole.

10. The catamaran of claim 9 wherein said cap is cylindrical in shape, said bore is concentric therein and said cap contains an additional pair of axial bores through which said first and second lines are reeved.

11. The catamaran of claim 10 wherein said first and second lines are fiber rope.

12. The catamaran of claim 9 wherein said first and second lines are wire cables fixed by fasteners to said front surface of said cap.

* * * * *